United States Patent [19]

Nash et al.

[11] Patent Number: 4,557,021

[45] Date of Patent: Dec. 10, 1985

[54] LAYING OUT AND OPENING OF FIBER BALES

[75] Inventors: Ronald S. Nash; L. Dale Cash, both of Gastonia, N.C.

[73] Assignee: Fiber Controls Corporation, Gastonia, N.C.

[21] Appl. No.: 249,408

[22] Filed: Mar. 31, 1981

[51] Int. Cl.[4] ..... D01G 13/00

[52] U.S. Cl. ..... 19/80 R; 19/145.5

[58] Field of Search ..... 19/80 R, 81, 145.5; 241/101 A, 101.7, 277, 283; 414/313, 507, 518

[56] References Cited

U.S. PATENT DOCUMENTS

| | | | |
|---|---|---|---|
| 2,256,577 | 9/1941 | Remington | 19/145.5 |
| 3,057,608 | 10/1962 | Patz et al. | 414/313 |
| 3,110,062 | 11/1963 | Wildbolz et al. | 19/145.5 X |
| 3,577,599 | 5/1971 | Goldammer et al. | 19/145.5 |
| 3,777,908 | 12/1973 | Keller | 19/145.5 X |
| 3,806,990 | 4/1974 | Goldammer et al. | 19/145.5 |
| 3,951,282 | 4/1976 | Keller | 19/80 R |
| 4,227,836 | 10/1980 | Sizelove et al. | 414/313 X |

FOREIGN PATENT DOCUMENTS

| | | | |
|---|---|---|---|
| 2040867 | 9/1980 | United Kingdom | 414/313 |

*Primary Examiner*—Louis K. Rimrodt

*Attorney, Agent, or Firm*—Cushman, Darby & Cushman

[57] ABSTRACT

A method of textile fiber bale opening wherein fiber bales are laid within a circle on the floor in a predetermined arrangement and are opened by a beater which rotates about the center of the circle and sweeps over the tops of the bales to loosen and strip fibers therefrom.

9 Claims, 10 Drawing Figures

FIG 5
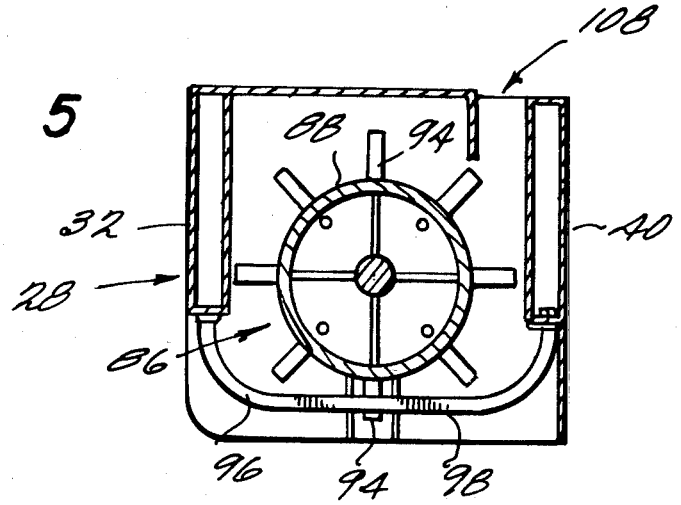
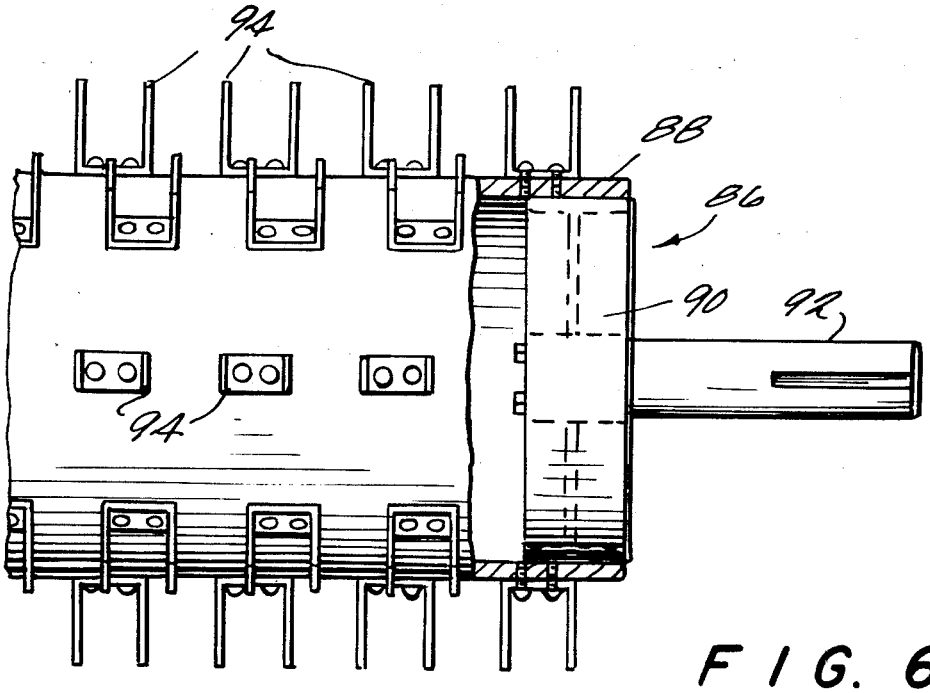
FIG. 6

LAYING OUT AND OPENING OF FIBER BALES

This invention relates to the opening of textile fiber bales, and in particular to opening same when disposed on a floor surface in a circular area.

In the past, bale openers have been developed which require a huge floor space per bale, for example in a large rectangular area where much of the space is not in fact employed to strip fibers from the bale, or in a circular area where the bales only occupy the outer periphery of the circular circle.

The present invention represents a significant improvement over the past arrangements and provides for a very efficient bale laydown arrangement, conserving much space and providing for a very clean removal of the fibers which are stripped off the top of the bales in a cyclical process of sweep, step down, and re-sweep over the top of the bales.

This invention will become more clear upon reading the detailed description which follows this brief description of the drawings, in which:

FIG. 5 is a cross-sectional view of the beater assembly,

FIG. 6 is a partial view of the rotary beater,

DESCRIPTION OF PREFERRED EMBODIMENT

Figure 1:
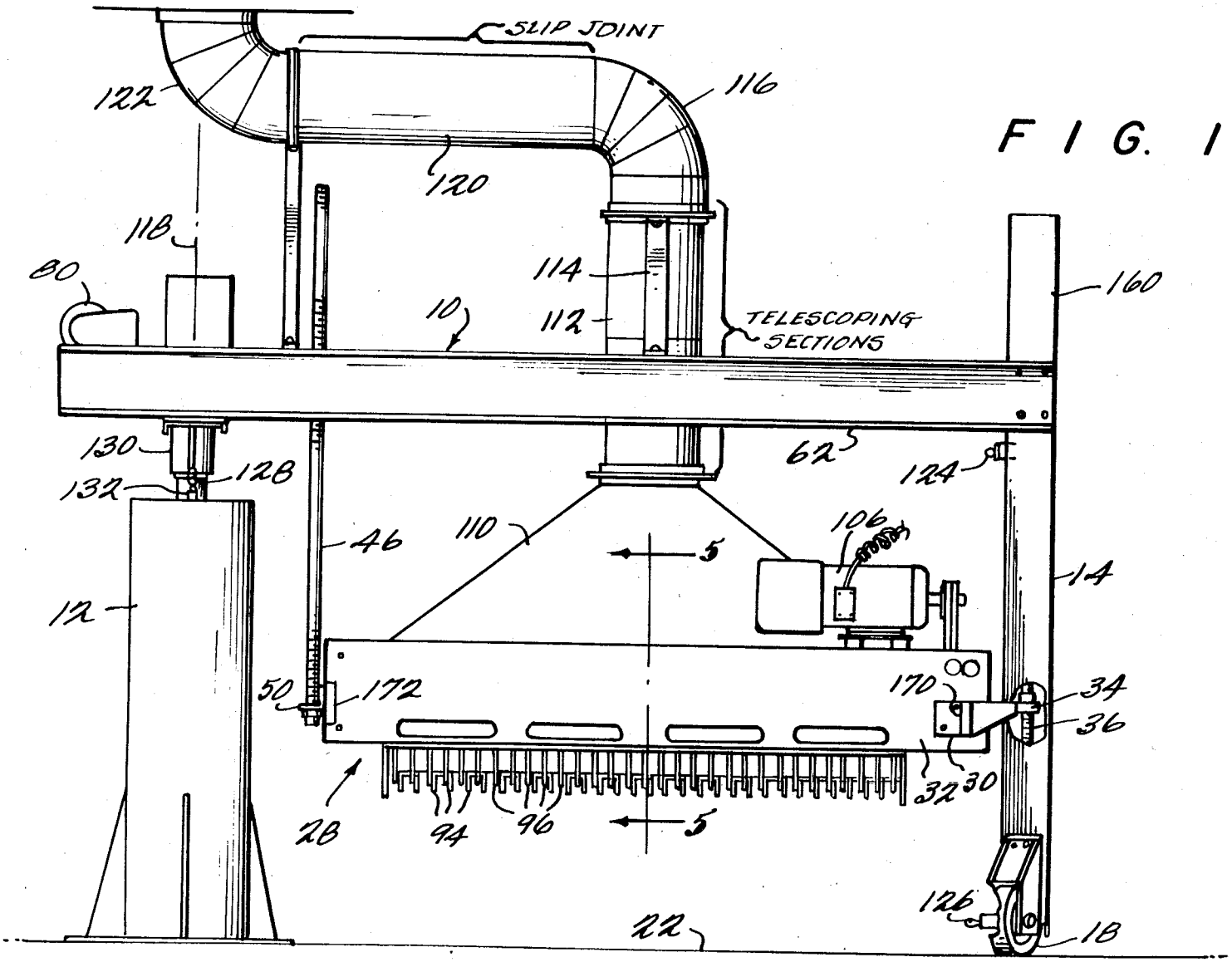
FIG. 1 is a front elevational view of the equipment.

In FIGS. 1–4, it will be seen that boom 10 is fixed at its inside end to rotate horizontally about the vertical axis of the central column or pylon 12. At its outer end, boom 10 supports two legs 14 and 16 (FIG. 4) at the bottom of which are wheels 18 and 20, respectively. Pylon 12 and wheels 18 are supported by a floor structure 22, and the wheels circumscribe a circle about post 12 when the rear wheel 20 is driven via chain 24 by motor 26.

Boom 10 and legs 14 and 16 together form frame means which carries a beater assembly 28. On the outside end, beater assembly 28 is supported by virtue of a pair of brackets 30 and 31, the former being secured to the front beater plate 32 and has on its outer end, inside leg 14, a nut or collar 34 which is threaded on the rotatable vertical screw 36. This screw is secured at its lower end inside leg 14 by a holder 38 which allows the screw to rotate without moving vertically. Similarly, the other bracket 31 is secured to the back plate 14 of the beater assembly 28 and has a nut or collar 42 which is threadedly engaged with the rear vertical screw 44 located inside the rear leg 16. This screw 14 is also secured at the bottom of leg 16 to allow rotation but no vertical movement.

The inside end of beater assembly 28 is also secured to the frame means by way of an additional pair of vertical screws 46 and 48 which at their lower ends are stationarily secured to horizontal bracket 50 which in turn is secured to the inside end of beater assembly 28. Vertical screws 46 and 48 are nonrotatable, and have threadedly engaged on them respective nuts or collars 52 and 54 which preferably are of the ball screw type as are the earlier mentioned collars or nuts 34 and 42. Collars 52 and 54 are secured to respective L-shaped brackets 56 and 58, which in turn are secured at their foot portion to the base 60 at the central portion of the frame, the upright portions of brackets 56 and 58 being respectively secured to beams 62 and 68 which form part of boom 10.

Threaded collars 52 and 54 also have secured to them sprockets 70 and 72, respectively. At the other end of the boom, the other two vertical screws 36 and 44 have secured to them respective sprockets 74 and 76. Entrained around these four sprockets 70, 72, 74 and 76 is a chain 78 which is driven by motor 80 via a gear reducer 82 and sprocket 84. When motor 80 turns sprocket 84, thereby driving chain 78, the four corner sprockets 70–76 are rotated simultaneously. At the outer end, since sprockets 74 and 76 are fixedly secured to the vertical screws 36 and 44, movement of the chain causes those vertical screws to rotate, which in turn requires the respective threaded collars 34 and 42 to move vertically, up if the screws are rotated in one direction and downwardly if they are rotated in the opposite direction. Concurrently, on the inner end, the rotation of sprockets 70 and 72 by virtue of the movement of chain 78, causes the threaded collars 52 and 54 to rotate therewith. Since these collars are fixed in their vertical position, the respective vertical screws 46 and 48 which are threadedly engaged with those rotating collars, are required to move vertically, up or down according to the direction of rotation of chain 78.

It can be seen from the foregoing, therefore, that the up/down motor 80, when energized, will cause the beater assembly to move up or down according to the direction of motor rotation.

Beater assembly 28 is shown more particularly in FIGS. 5 and 6. Internally, there is a rotary beater 86 which includes a cylinder 88 with end webs 90 mounting stub shafts 92 which are respectively mounted in end plates not shown of beater assembly 28. On the outside of cylinder 88 are a multiplicity of two pronged beater spikes or pluckers 94. As shown in FIG. 6, these are arranged in longitudinal rows which are equally spaced circumferentially as seen in FIG. 5 wherein it is apparent that eight such rows are shown. From FIG. 6, it will be noted that the beater spikes 94 are slightly staggered from row to row, one set of alternate rows being on one longitudinal position while the other alternate set of spikes is on a different longitudinal position.

Beater assembly 28 also includes a multiplicity of grids 96 of cradle shape with their opposite ends secured to the front and back plates 32 and 40 of the assembly. These grids have a lower flat portion 98 which as seen in FIG. 5 does not extend downward quite as far as a beater spike 94 which is oriented vertically downward. The reason for this is explained below.

Rotary beater 86 is mounted in the beater assembly so that its outer shaft 92 extends externally and has secured to it a pulley 100 which is connected to pulley 102 by way of belt 104. Pulley 102 is in turn connected to the beater motor assembly 106, whereby upon rotation of the beater motor, rotary beater 86 is rotated about its longitudinal axis.

Figure 2:
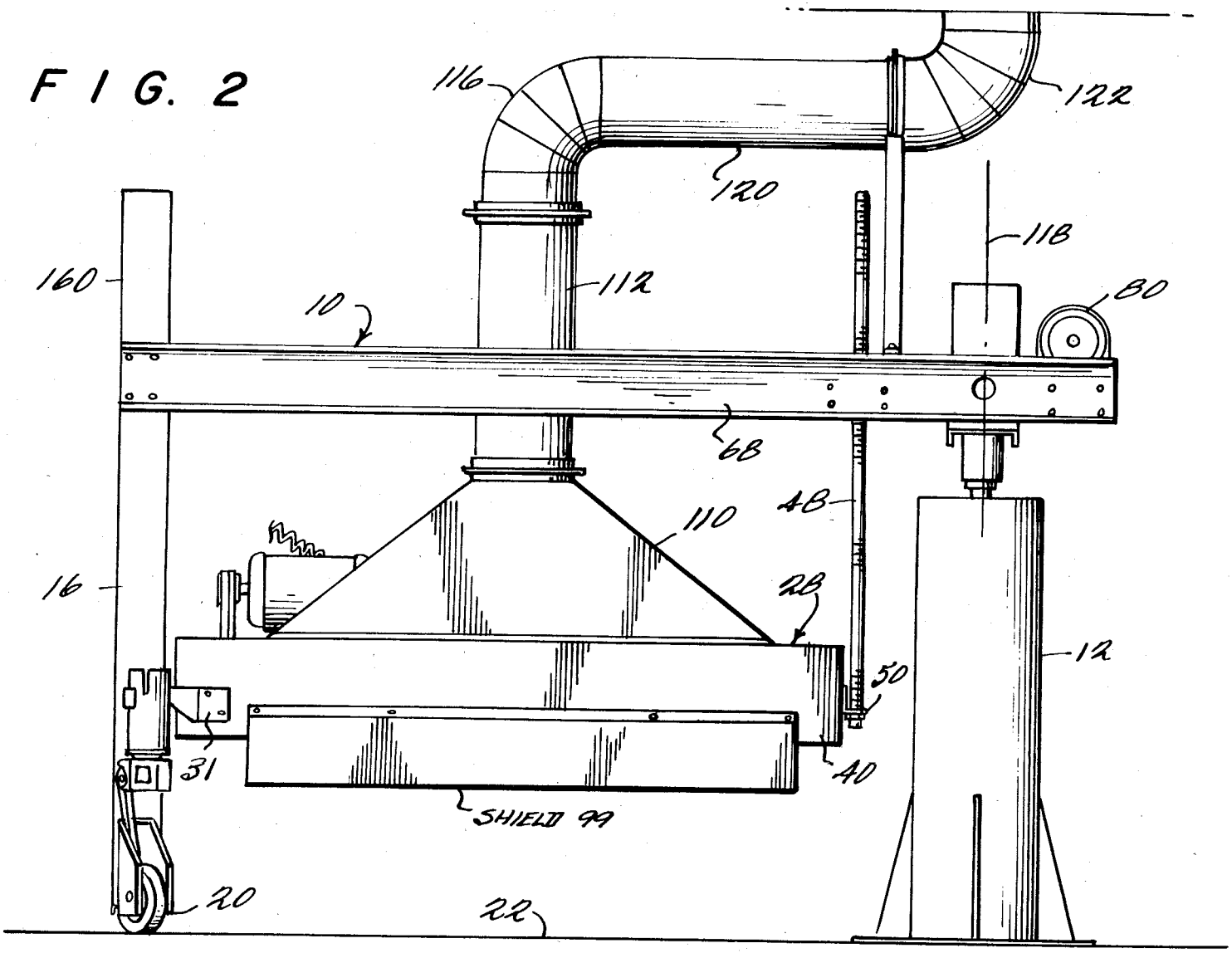
FIG. 2 is a rear elevational view of the equipment.
Figure 3:
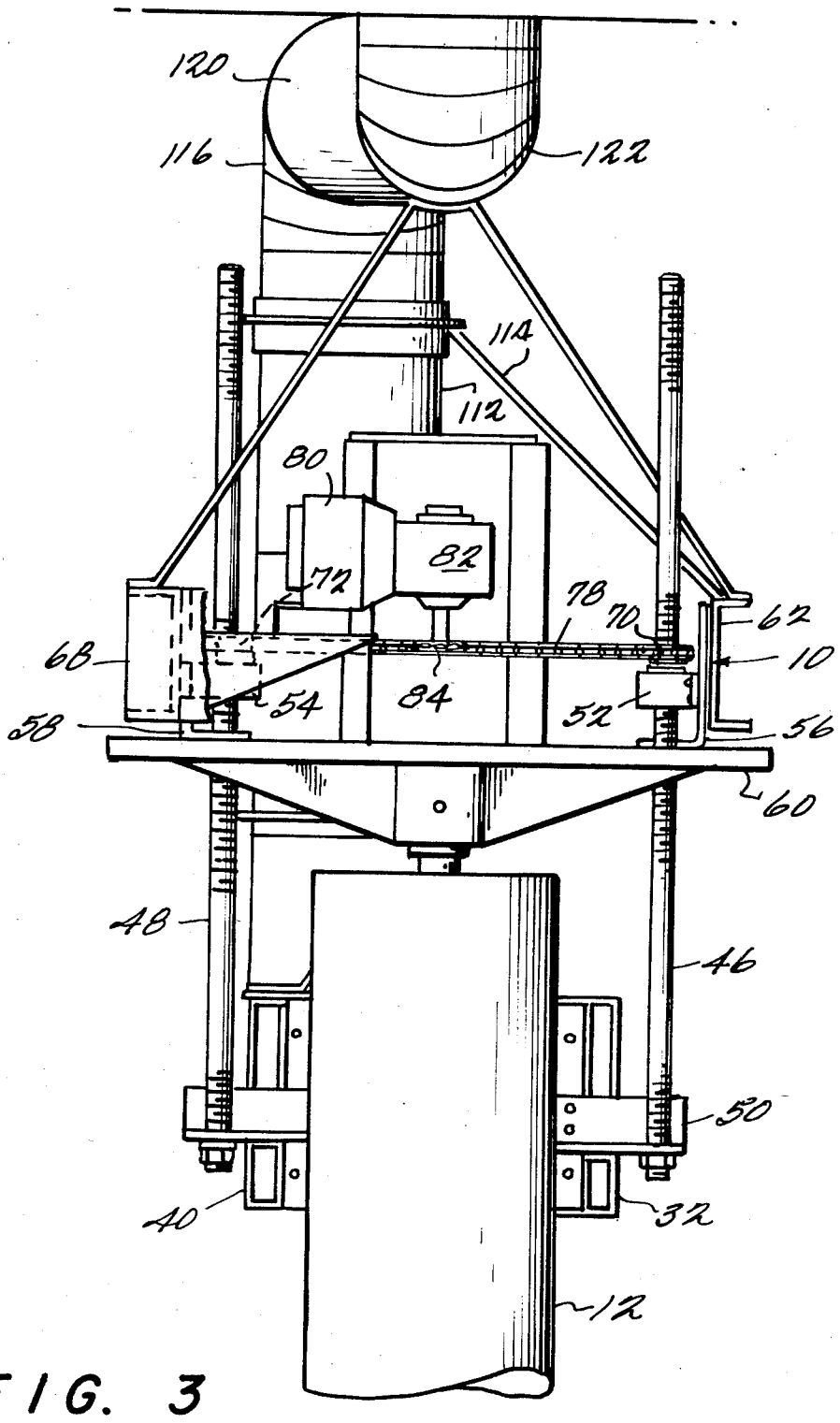
FIG. 3 is a partial inside end view.
Figure 4:
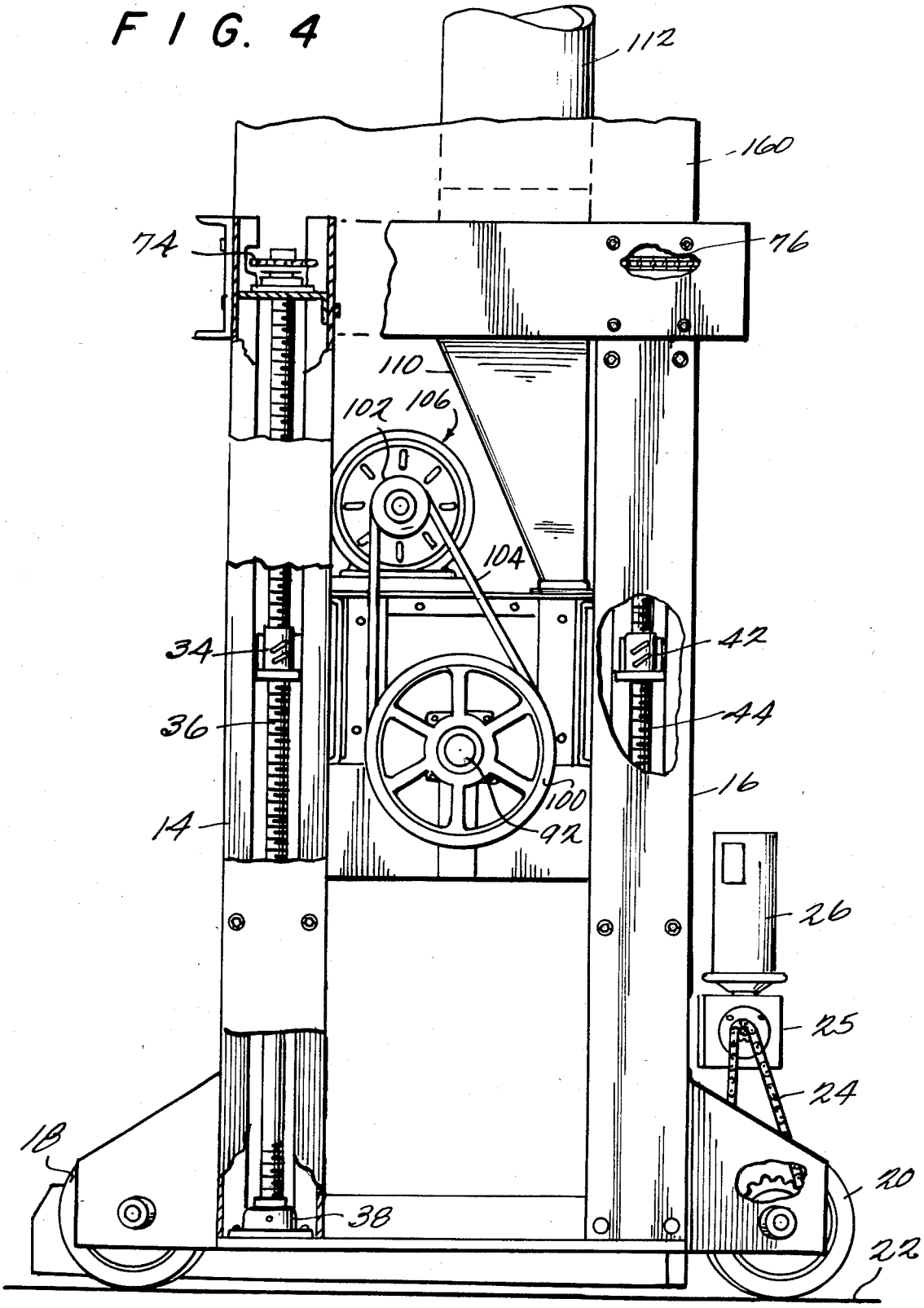
FIG. 4 is a partial outside end view.

In FIG. 5, it will be noted that the upper end of beater assembly 28 has an opening 108 which is connected to transition duct 110 shown in FIGS. 1, 2 and 4. As is apparent therefrom, the opening 108 in beater assembly 28 extends over the length of rotary beater 86, and transition 110 communicates the long rectangular opening 108 to a round duct 112, for example of conventional 12 inch diameter, which is composed of four telescoping sections to allow for the up/down movement of beater assembly 28 and transition 110. At its upper end, duct sections 112 are secured to the boom 10 by struts 114, and hence the corner duct 116 is at a predetermined, constant, height above floor 22. Since boom 10 is rotated about the vertical axis 118 of the center column 12, and since ducts 116, 120 and corner duct 122 rotate therewith, it is necessary to center the corner duct 122 on axis 118. For this purpose, duct 120 has telescoping sections so as to be an effective slip joint to regulate the proper position of corner duct 122. Not shown, but above corner duct 122 is usually another right angled duct which connects via another slip joint to horizontally extending stationary duct work which conveys the fibers to their ultimate destination by virtue of a suction fan.

As will be noted in FIG. 1, leg 14 carries an upper limit switch 124, which is triggered when the beater assembly 28 rises to the level of that switch. On the other hand, when beater assembly 28 is lowered to come into contact with the lower limit switch 126, also mounted on leg 14, that switch is triggered thereby. A further limit switch 128 is mounted on the revolving central post 130 to be triggered once per revolution by the adjustable trip 132 which is stationarily mounted on the pylon or column 12. These three limit switches are discussed in more detail in the subsequent description of the electrical circuitry in FIG. 6.

Figure 7:
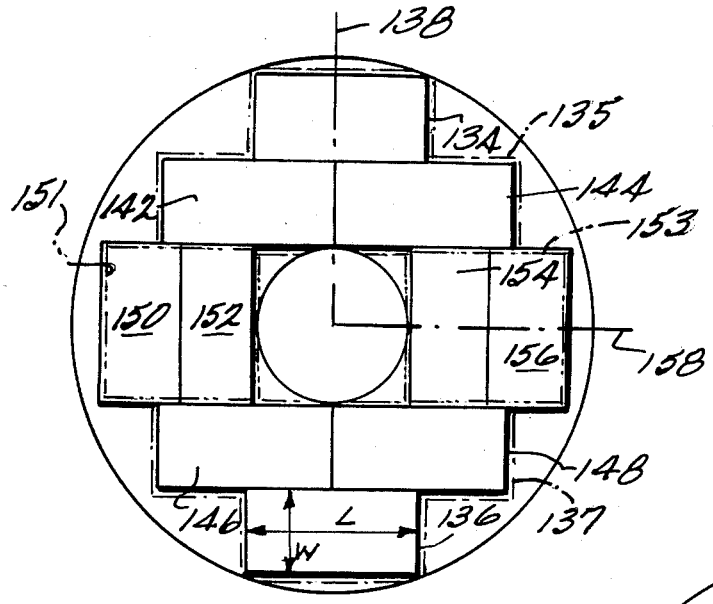
FIGS. 7–9 illustrate different bale laydown arrangements for different size areas.
Figure 8:
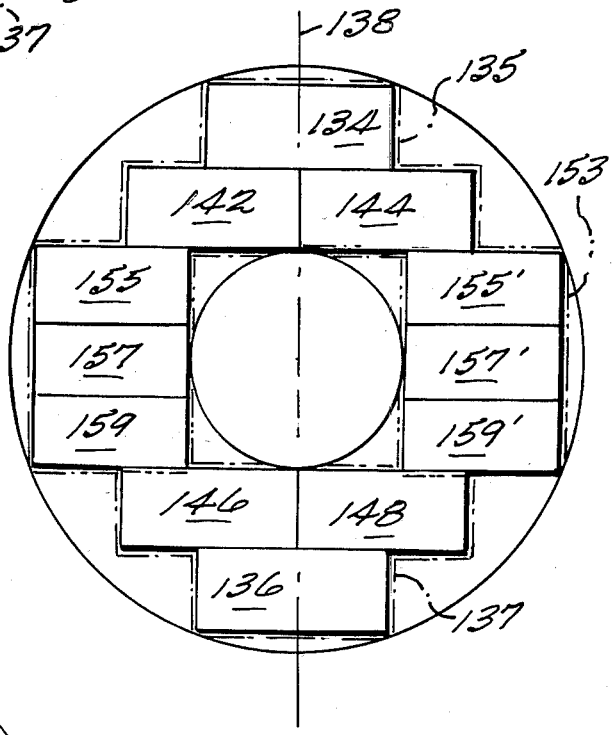
Figure 9:
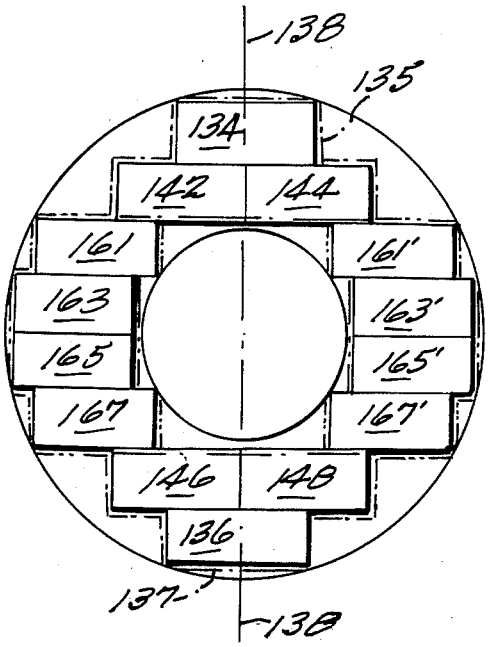

Before proceeding to the electrical circuitry and operation of the equipment, reference is first made to FIGS. 7, 8 and 9 which diagrammatically show three different size bale laydown areas for respectively accommodating 10, 12 and 14 bales. In all of the arrangements, the bales are considered to be approximately 28 inches wide (see dimension w in FIG. 7) and 56 inches long (see dimension L in FIG. 7). In practice, the outer circles in FIGS. 7, 8 and 9 are respectively 14.5 feet, 16.5 feet and 18.5 feet in diameter, while the inner circles have respective radii of 27 inches, 37 inches and 47 inches. These outer and inner circles represent the outer and inner ends of the operative part of the rotary beater 86, i.e., the general locations of the beater spikes 94 and grids 96 at opposite ends of the rotary beater 86. With such dimensions for the outer and inner circles in FIGS. 7, 8 and 9, it has been discovered that the maximum number of fiber bales of standard USDA size that can be fitted into the area between those circles is 10, 12 and 14 respectively as shown in those figures. In other words, the maximum number of bales can be put into those respective areas, if the bales are arranged in the manner shown in FIGS. 7, 8 and 9, respectively. For example, in FIG. 7 it will be noted that the arrangement places two bales 134 and 136 perpendicular to and at the outer end of a diameter line 138. Slightly inward from those two bales are a pair of bales 142, 144 and another pair of bales 146, 148, the bales of each pair being perpendicular to and on opposite sides of line 138. The other four bales 150, 152, 154 and 156 extend parallel to line 138, two lying on one side of the inner side of the circle and two on the other side thereof, centered on line 158.

Bales 134, 142 and 144 together comprise a first bale section (shown as single-dashed phantom line 135 in the accompanying FIGS. 7–9) whereas bales 136, 146 and 148 together comprise a second bale section (shown as single-dashed phantom line 137 in the accompanying FIGS. 7–9). First and second bale sections 135, 137, respectively, are symmetrically opposed to one another about diameter line 158 in each of the arrangements shown in FIGS. 7, 8 and 9. Similarly, bales 150, 152 together comprise a third bale section (shown as double-dashed phantom line 151 in FIGS. 7–9) while bales 154, 156 together comprise a fourth bale section (shown as double-dashed line 153 in FIGS. 7–9).

In like manner, the specific arrangements illustrated in FIGS. 8 and 9 for the respective 12 and 14 bale laydowns can be described relative to the disposition of the respective bales in the areas between the outer and inner circles.

For example, with reference to FIG. 8, it is seen that first and second bale sections 135, 137 comprising bales 134, 142 and 144, and 136, 146 and 148, respectively, are positioned in a similar manner to that described above with respect to the FIG. 7 embodiment. However, the FIG. 8 embodiment includes three bales for each of the third and fourth bale sections (e.g. bales 155, 157 and 159 comprising third bale section 151, and bales 155', 157' and 159' comprising the fourth bale section 153) which bales are placed in a side-by-side manner between the first and second bale sections 135, 137, respectively, so that the length dimension L of each individual bale is substantially parallel to diameter line 158. Once again, third and fourth bale sections 151, 153, respectively, are centered on diameter line 158.

FIG. 9 depicts the third bale lay-down embodiment in accordance with the present invention and, once again, it is readily apparent that the first and second bale sections 135, 137, respectively, are similar to that described above with regard to FIG. 7. However, the FIG. 9 embodiment differs with respect to the third and fourth bale sections 151, 153, respectively, each of which now comprise two pairs of bales (e.g. two outer pair of bales 161, 167 and 161', 167' for third and fourth bale sections 151, 153, respectively, and two inner pair of bales 163, 165 and 163', 165' for third and fourth bale sections 151, 153, respectively). Taking third bale section 151 as an example (it being understood that fourth bale section 153 is identical, but opposite hand), inner bales 163, 165 are laid down in a side-by-side fashion interiorly of outer bales 161, 167, the latter being laid down in a side-by-side fashion relative bales 163 and 165, respectively. Each of the bales 161, 163, 165 and 167 are also laid down so that their respective length dimensions L are substantially parallel to diameter line 158. Of course, outer bales 161 and 167 must be displaced towards the coincident center points of the inner and outer circles so as to ensure that they are laid down within the annular area defined therebetween.

In an actual operation, according to the size of the equipment, bales of fiber are initially laid down on floor 22 which is outlined as to bale positions in accordance with one of FIGS. 7, 8 and 9. The outlining may be done by paint, strips of tape, etc. In any event, the workers place the bales in the positions outlined on the floor, while the equipment is stopped, and then it is ready for operation.

The circuitry for generally operating the equipment above described is housed in a cabinet 160 located atop the outer end of boom 10. Much of the circuitry shown in FIG. 10 is contained in that cabinet.

Figure 10:
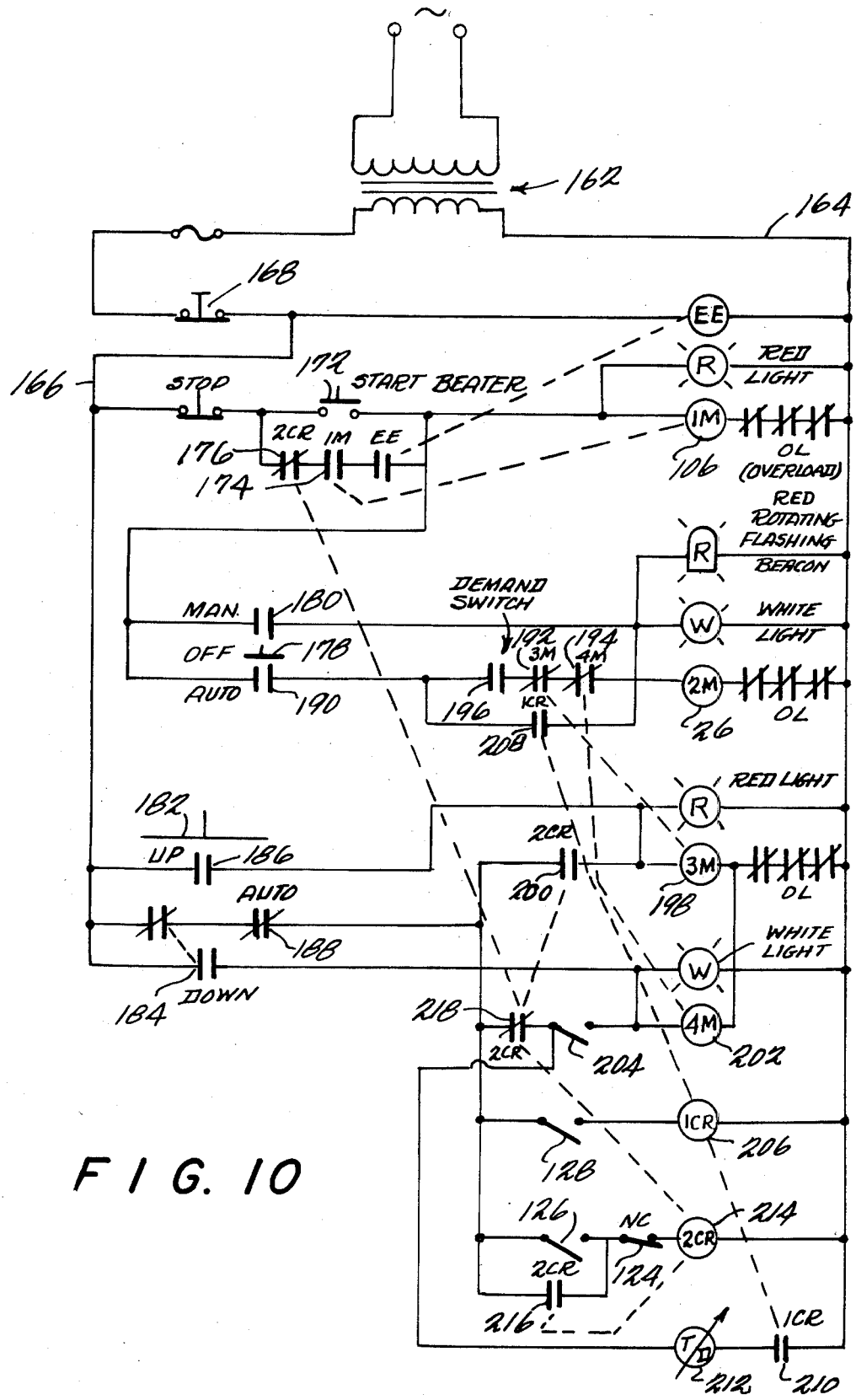
FIG. 10 is a schematic diagram of electrical circuitry for use with the disclosed equipment.

In FIG. 10, transformer 162 feeds lines 164 and 166 through an emergency stop switch 168, energizing an electric eye 170. In FIG. 1, this electric eye is mounted on bracket 30, with a reflector 172 being mounted on the opposite end of the beater assembly 28, and serves to turn off the beater equipment shou1d the beam be interrupted by a person or otherwise, as a safety feature. When the electric eye 170 is energized, then its contacts EE are closed, but when those are opened by such interruption, the beater motor 106 can no longer receive current, thereby stopping the beater from rotating.

When it is desired to start up the equipment, the beater start button 172 is momentarily pushed, providing current to operate the beater motor 106 (actually to operate its magnetics 1M which cause the motor to rotate). This closes the 1M contacts 174, which are in a circuit paralleling the start switch 172, thereby holding in the magnetics of motor 106, since the electric eye contacts EE are already closed and contacts 176 are also already closed as will be described below.

With the rotary beater 86 thereby being caused to rotate, the next step is to make sure that the beater assembly is not setting in such a vertical position or radial position as to be operating either the upper or lower switches 124, 126 or the 360° switch 128. This is accomplished by operating boom rotation switch 178 to its manual contacts 180, energizing the 2M magnetics of the boom rotation motor 26 momentarily. To get the beater assembly 28 off of either the upper or lower limit switches, the beater index switch 182 must be held momentarily against the down contacts 184 or the up contacts 186. This switch is a three position switch which is spring loaded to its third or automatic position in which its contacts 188 are closed for safety purposes. Operation of the beater index switch to close its down contacts 184 will move the beater assembly 28 downward to the desired starting height in a manner discussed below.

After that, the boom rotation switch 178 is placed in its automatic position, which closes contacts 190, while the beater index switch 182 maintains its contacts 188 automatically closed. Between contacts 190 and the magnetics for boom rotation motor 26 are normally closed contacts 192 and 194 which are discussed below, and contacts 196. These latter contacts 196 are associated with the next process which is controlling whether or not fibers should be fed to it from this bale opening equipment. Contacts 196 could therefore be the feed or demand switch on a card feeder, distributor, reserve chute, hopper of any kind, etc. which needs fibers for further processing. If that next process says it needs more fibers, then contacts 196 are closed, and the boom motor 26 will cause the boom and beater assembly to rotate about the vertical axis of pylon 12.

As the boom rotates, rotary beater 86 is rotating on its own longitudinal axis above or on top of the bales of fiber which are laid on the floor in accordance with FIGS. 7–9. Grids 96 at spaced intervals along the underside of the beater assembly 28 operate to press down on the top of the fiber bales to hold down the fibers, while the beater spikes 94 rotate down below the level 98 of grids 96 in order to pluck or beat or strip off fibers from the bales as the beater rotates and it is simultaneously moved forward in a circle about pylon 12. The stripped fibers are pulled by a reaction fan (not shown) up through transition 110 into the ducts for transport on toward the using equipment.

Since the beater index switch 182 is in its automatic position whereby contacts 188 are closed, current cannot reach either the 3M up magnetics 198 or 4M down magnetics 202 of the up/down motor 80, since the 2CR contacts 200 are open as is the time delay switch 204. Hence, while the boom and beater are rotating, the up/down motor 80 is prevented from operating, and consequently the beater assembly 28 stays at the same level at which it started its present cycle around pylon 12. However, when the 360° switch 128 is caused to close at a given azimuth position of boom 10 by virtue of the location of trip 132, control relay 206 is energized, causing its contacts 208 and 210 to close. The former keeps the boom rotating a moment until the 360° limit switch 128 reopens, thereby deenergizing control relay 206. On the other hand, the closing of contacts 210 when that control relay was first energized, energized a time delay 212, which immediately closed its time delay contacts 204. These contacts 204 remain closed for a predetermined time set into the time delay relay 212 which is adjustable from 0 to 30 seconds for example. As will be appreciated hereinafter, the amount of time that contacts 204 is closed determines how far down beater assembly 28 is moved, as will now be explained.

With time delay contacts 204 closed, the 4M down magnetics 202 is energized, causing the up/down motor 80 to rotate chain 78 in the direction which will move beater assembly 28 downward. That downward progression continues until the time delay contacts 204 reopen, at which time the beater assembly no longer moves downward. In practice, the parameters have been such that a 30 second delay corresponds to about 4 inches of travel, and the normal delay allowed is in the area of about 10 seconds. This is, as earlier indicated, adjustable to meet the needs of any given situation.

It will be noted that the beater assembly does not screw down continuously but only in a stepped manner, a given amount once each cycle, but only while the boom is stopped. This prevents any choke problem of the beater due to torque, and consequently prevents motor burn out problems.

The foregoing rotation of the boom for a cycle, stopping the boom and lowering the beater assembly a given amount, restarting the boom rotating, is repeated cyclically until such time as the beater assembly trips the lower limit switch 126. Closing of this switch causes the second control relay 214 to be energized, which immediately pulls in its own contacts 216 to form a holding circuit. It also opens its contacts 218 and 176. The opening of contacts 218 is for the purpose of opening the timing circuit, i.e., preventing current from reaching time delay 212 even if the 360° limit switch 128 is closed somehow or other during the present process. The opening of contacts 176, on the other hand, opens the circuit to the 1M magnetics of the beater driving motor 106, thereby deenergizing that motor and stopping the rotation of the rotary beater 86. Energization of control relay 214 also causes closure of its contacts 200, thereby energizing the 3M up magnetics 198, causing the up/down motor 80 to rotate chain 78 in the direction to move beater assembly 28 upward. It will be noted that the 3M magnetics 198 also open their contacts 192, thereby preventing boom motor 26 from rotating the boom while the beater assembly 28 is moving upward. The same thing happens when the 4M down magnetics 202 is energized, i.e., its contacts 194 are opened to prevent boom rotation during the downward movement of the beater assembly 28.

While the beater assembly is moving upward, workmen again lay down a new set of bales in one of the patterns according to FIGS. 7–9. As soon as the beater assembly 28 reaches the normally closed upper limit switch 124, that switch is tripped open, thereby deenergizing control relay 214, causing its closed contacts 200 and 216 to reopen and causing its open contacts 176 and 218 to reclose. The equipment stops in this position and waits for manual operation of the beater index switch 182 to move the beater assembly 28 back down to a position at which the equipment is ready to start automatically stripping fibers from the new set of bales.

The foregoing describes an operative embodiment of the invention, but it is to be understood that this invention is not limited by the foregoing description but by the appended claims.

We claim:

1. The process of stripping textile fibers off the tops of a plurality of bales thereof, said bales having a predetermined width dimension W and a predetermined length dimension L, said process comprising the steps of:

laying down said plurality of bales entirely in the annular area between outer and inner concentric circles including first and second bale sections symmetrically opposing one another about a first axis of symmetry which passes through the coincident center points of said outer and inner circles, and third and fourth bale sections disposed between said first and second bale sections and symmetrically opposing one another about a second axis of symmetry which perpendicular to said first axis at said center points, said laying down including disposing three bales in each of said first and second bale sections, one of said three bales in each of said first and second sections being laid down parallel to said first axis of symmetry so as to have its said length dimension L substantially bisected by said second line of symmetry, the remaining two bales being laid down end to end in an abutting manner between said one bale and said inner circle, the abutting ends of said two bales defining a line colinear to said second axis of symmetry; and stripping fibers from the laid down bales by cyclically moving a rotating beater, which is disposed in a radial position between said circles, over the tops of said plurality of bales and conintually lowering the beater until a desired amount of stripped fibers is obtained.

2. The process as in claim 1 wherein the step of laying down bales further includes disposing a pair of side-by-side bales in each of said third and fourth bale sections, each of said pair being laid down between said first and second bale sections so as to have each of their said length dimensions L substantially parallel to said second axis of symmetry.

3. The process as in claim 1 wherein the step of laying down bales further includes disposing three side-by-side bales in each of said third and fourth bale sections, each of said three bales being laid down between said first and second bale sections so as to have each of their said length dimensions L substantially parallel to said first axis of symmetry.

4. The process as in claim 1 wherein the step of laying down bales further includes disposing a first pair of outer separated bales and a second pair of inner side-by-side bales in each of said third and fourth bale sections, said second pair being laid interiorly of said first pair, and wherein each of said first and second pairs are mutually laid down in a side-by-side fashion between said first and second bale sections so as to have each of thier said length dimensions L substantially parallel to said first axis of symmetry.

5. The process as in claim 1 wherein the last step is practiced by first stopping said cyclical movement of said beater at the end of each circumferential cycle, them lowering the beater a given amount and thereafter re-starting said cyclical movement of the beater for another cycle.

6. The process as in claim 1 wherein the last step is practiced by lowering the beater a given amount at the end of each circumferential cycle.

7. A method of stripping fibers from the tops of a plurality of bales each of said bales having a length dimension approximately twice the width dimension, said method comprising the steps of:

laying down a plurality of said bales completely within an area defined between two concentric circles in first and second pairs of opposing bale groupings wherein each one of said first pair of opposing bale groupings comprises two abutting bales placed end-to-end defining substantially continuous interior and exterior vertical bale sufaces having an overall dimension approximately twice said length dimension and one bale disposed adjacent said exterior surface of said two bales in a manner wherein the length dimension of said one bale is substantially bisected by a line formed by the end-to-end placement of said two bales, and wherein each one of said second pair of opposing bale groupings comprises a pair of bales laid side-by-side between said first pair of opposing bale groupings to substantially form a square having each side approximately equal to said length dimension; and moving a rotating beater over the tops of said first and second opposing pairs of bale groupings to strip fibers from the tops of said bales until a predetermined amount of stripped fibers is obtained.

8. A method of stripping fibers from the tops of a plurality of bales, each of said bales having a length dimension approximately twice the width dimension, said method comprising the steps of:

laying down a plurality of said bales completely within an area defined between two concentric circles in first and second pairs of opposing bale groupings wherein each one of said first opposing bale groupings comprises two abutting bales placed end-to-end defining substantially continuous interior and exterior vertical bale surfaces having an overall dimension approximately twice said length dimension and one bale disposed adjacent said exterior surface of said two bales in a manner wherein the length dimension of said one bale is substantially bisected by a line formed by the end-to-end placement of said two bales, and wherein each one of said second pair of opposing bale groupings comprises a trio of abutting side-by-side bales disposed parallel to and between the interior surfaces of said first pair of bale groupings; and moving a rotating beater over the tops of said first and second opposing pairs of bale groupings to strip fibers from the tops of said bales until a predetermined amount of stripped fibers is obtained.

9. A method of stripping fibers from the tops of a plurality of bales, each of said bales having a length dimension approximately twice the width dimension, said method comprising the steps of:

laying down a plurality of said bales completely within an area defined between two concentric circles in first and second pairs of opposing bale groupings wherein each one of said first opposing pair of bale groupings comprises two abutting bales placed end-to-end defining substantially continuous interior and exterior vertical bale surfaces having an overall dimension approximately twice said length dimension and one bale disposed adjacent said exterior surface of said two bales in a manner wherein the length dimension of said one bale is substantially bisected by a line formed by the end-to-end placement of said two bales, and wherein each one of said second pair of opposing bale groupings comprises an outer pair of bales and an inner pair of bales disposed interior to and abutting said outer pair of bales, each of said inner and outer pairs of bales being disposed parallel to and between said interior bale surfaces, said outer pair of bales being further disposed in an interiorly offset relationship relative said interior pair of bales so that said each one of said second pairs of groupings will lie entirely in the area defined between said concentric circles; and moving a rotating beater over the tops of said first and second opposing pairs of bale groupings to strip fibers from the tops of said bales until a predetermined amount of stripped fibers is obtained.

* * * * *